US005334078A

United States Patent [19]

Hippely et al.

[11] Patent Number: 5,334,078

[45] Date of Patent: Aug. 2, 1994

[54] TOY VEHICLE HAVING ARTICULATED JAWS

[75] Inventors: Keith A. Hippely, Manhattan Beach; Gary Swisher, Hermosa Beach; Terence A. Choy, Lawndale; Wayne R. Halford, Manhattan Beach, all of Calif.

[73] Assignee: Mattel, Inc., El Segundo, Calif.

[21] Appl. No.: 930,574

[22] Filed: Aug. 17, 1992

[51] Int. Cl.[5] ..... A63H 7/00; A63H 17/273; A63H 17/25

[52] U.S. Cl. ..... 446/470; 446/465; 446/275; 446/288; 446/290; 446/330

[58] Field of Search ..... 446/288, 289, 275, 290, 446/330, 357, 376, 378, 470, 469, 340, 427

[56] References Cited

U.S. PATENT DOCUMENTS 1,486,101 3/1924 Megorden .
1,490,185 4/1924 Ross .
2,329,564 9/1943 Thomas .
2,534,609 12/1950 Mann ..... 446/289
3,056,231 10/1962 Tieri ..... 446/289
4,186,515 2/1980 Ogawa .
4,307,533 12/1981 Sims et al. .
4,324,065 4/1982 Cooper .
4,424,978 1/1984 Kassai .
4,477,999 10/1984 Harigai et al. .
4,561,854 12/1985 Amici et al. .
4,568,307 2/1986 Gabler et al. ..... 446/448
4,599,078 7/1986 Obara .
4,685,894 8/1987 Beny et al. .
4,750,895 6/1988 Shinohara et al. .
4,778,433 10/1988 McKay et al. .

*Primary Examiner*—Danton D. DeMille
*Attorney, Agent, or Firm*—Roy A. Ekstrand

[57] ABSTRACT

A toy vehicle includes a chassis supported by a plurality of wheels. A body includes a jaw which supports a plurality of teeth and is pivotally secured with respect to the chassis. A lever mechanism is coupled to the body and jaw and operates in response to user imposed force to configure the vehicle in either a closed or open mouth configuration.

5 Claims, 4 Drawing Sheets

TOY VEHICLE HAVING ARTICULATED JAWS

FIELD OF THE INVENTION

This invention relates generally to toy vehicles and particularly to those having articulated components thereon.

BACKGROUND OF THE INVENTION

Toy vehicles have proven to be a consistent and popular category of toy merchandising through the years. Understandably, toy vehicle manufacturers have provided a virtually endless variety of shapes, sizes and configurations for such popular toys. Generally, toy vehicles comprise a body and/or chassis combination which supports a plurality of rolling wheels. In some vehicles, a self-powered drive mechanism is also provided. The appearance of such toy vehicles varies greatly from extremely realistic lifelike miniatures to very fanciful appearance vehicles replicating monsters, animals, insects and the like. To further enhance the appeal and play value of toy vehicles, manufacturers have often provided articulated elements thereon. In addition, a somewhat more recent type of articulated toy vehicle has come to be known generally as transformable in that the articulated vehicle components may be reconfigured to completely and dramatically change toy vehicle appearance.

For example, U.S. Pat. No. 4,307,533 issued to Sims, et al. sets forth an INSECT SIMULATING MOBILE TOY HAVING FLAPPABLE WINGS having a body configured to simulate an insect and a movable head and tail. A pair of pivotally secured wings are coupled to the body and a mechanism is provided to cause simultaneous flapping of the wings.

U.S. Pat. No. 4,424,928 issued to Kassai sets forth a VEHICLE FOR CHILDREN having a body and rolling wheels of sufficient strength and size to support a seated child. A hood-like portion is pivotally secured to the body and may be opened and closed. A fanciful tongue-like element is supported beneath the hood and gives the appearance of an open mouth to the vehicle when the hood is raised.

U.S. Pat. No. 4,477,999 issued to Harigai, et al. sets forth a TRANSFORMABLE TOY VEHICLE which may be configured to replicate a small compact truck-like vehicle. The vehicle comprises a chassis capable of being extended together with a plurality of movably secured body components allowing the vehicle to be reconfigured in several physical combinations to provide appearance differences.

U.S. Pat. No. 4,599,078 issued to Obara sets forth a TRANSFORMABLE TOY ASSEMBLY which includes a plurality of assembly elements which are separable and combinable with respect to each other and independently reversibly transformable between at least two forms different from each other. In one configuration, the toy resembles a truck-like vehicle while in an alternate configuration it assumes the appearance of a robot-like creation.

U.S. Pat. No. 4,685,894 issued to Beny, et al. sets forth a TOY VEHICLE WITH EJECTABLE FLYWHEEL SEAT AND OPENING GATES having front opening gates and an ejectable flywheel seat which may be used as a gyroscopic top or to propel the vehicle. The flywheel seat is removably mounted to the top of the vehicle and a launching lever is rotatably coupled to the front axle of the vehicle which may be used to simultaneously eject the flywheel seat and open two gates at the front of the vehicle.

U.S. Pat. No. 4,750,895 issued to Shinohara, et al. sets forth a RECONFIGURABLE TOY ASSEMBLY in which a spaceship-like vehicle is formed of a plurality of articulated elements which may be reconfigured with respect to each other to produce a robot-like appearing creature.

In addition to the foregoing described toy vehicles represented by the prior art described above, practitioners have provided additional toys applicating animals which also include some rolling mechanism or similar vehicle characteristic. For example, U.S. Pat. No. 1,486,101 issued to Megorden sets forth a TOY having a body replicating an alligator in its appearance. A tail is pivotally secured to the body together with a pivotally secured jaw mechanism. A pair or rolling wheels are supported within the body at the center and are coupled to eccentric pins which operate the pivotal tail and jaw as the toy is moved along a rolling surface.

U.S. Pat. No. 1,490,185 issued to Ross sets forth a FIGURE TOY having a dog-like body supported by rolling wheels at each of the four feet of the body. A pivotally secured jaw and pivotal tail are coupled to a linkage mechanism which extends outward from the body and terminates in a simulated leash. The movement of the simulated leash produces pivotal motion of the jaw and tail. A sound producing mechanism is operatively coupled to the leash linkage.

U.S. Pat. No. 2,329,564 issued to Thomas sets forth a TOY CROCODILE having a crocodile body and articulated jaw. A propulsion fan is coupled to the body and driven by a drive mechanism to propel the crocodile toy through the water.

U.S. Pat. No. 4,186,515 issued to Ogawa sets forth a TOY HORSE VEHICLE having articulated components capable of being reconfigured into a vehicle-like humanoid robot.

U.S. Pat. No. 4,324,065 issued to Cooper sets forth a BALANCE OPERATED GAME having a simulated alligator with a pivotally secure jaw mechanism. A trigger release mechanism and spring closure mechanism cooperate to provide a releasible latch mechanism for the upper jaw.

U.S. Pat. No. 4,561,854 issued to Amici, et al. sets forth a CREATURE WITH SNAP-ACTION JAW having a pair of body members defining a body cavity. The lower body member defines a lower jaw portion while the upper member defines an upper jaw. A lever mechanism is coupled between the jaw portions to provide pivotal motion of the jaw.

U.S. Pat. No. 4,778,433 issued to McKay, et al. sets forth a TOY CREATURE HAVING A TONGUE FOR CAPTURING PREY in which a body supports an articulated openable jaw and an extendable tongue member. Operative means are provided for extending and curling the tongue to capture a simulated prey object such as a small toy figure.

While the foregoing described prior art toys have provided additional amusement and play value, there remains nonetheless a continuing need in the art for evermore amusing and entertaining types of toy vehicles.

SUMMARY OF THE INVENTION

Accordingly, it is a general object of the present invention to provide an improved more amusing toy vehicle. It is a more particular object of the present invention to provide an improved more amusing toy vehicle having articulated jaws and interesting appearance change features.

In accordance with the present invention, there is provided a toy vehicle includes: support means including a plurality of wheels; a body defining a first jaw; a lever secured to the body; a second jaw coupled to the body; and operative means coupled to the lever for configuring the vehicle in either a closed jaw or open jaw position in response to lever position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
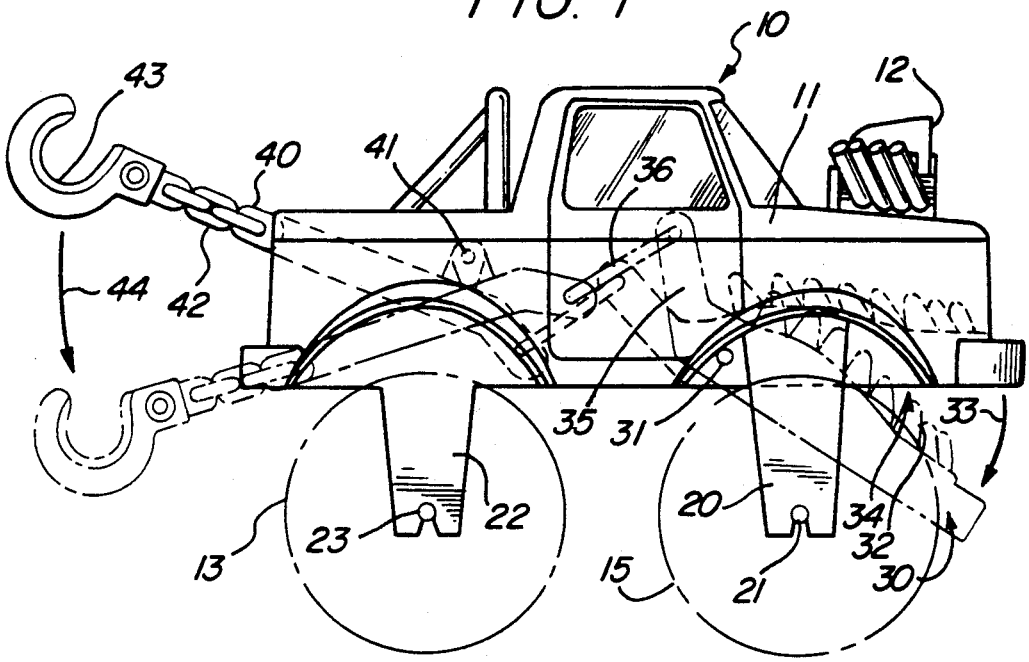
FIG. 1 sets forth a side view of a toy vehicle constructed in accordance with the present invention.

FIG. 1 sets forth a side view of a toy vehicle constructed in accordance with the present invention and generally referenced by numeral 10. Toy vehicle 10 includes a simulated pickup truck style body 11 having a pair of downwardly extending axle supports 20 and 22. Supports 20 and 22 receive a pair of transversely supported axles 21 and 23 which in turn support a plurality of wheels 13 through 16 (wheels 14 and 16 not seen in FIG. 1). Body 11 is essentially hollow defining an interior cavity 34. A simulated engine 12 extends upwardly from body 11. A movable jaw 30 defines a plurality of simulated teeth 32 and an angularly disposed arm 35. A pivot 31 pivotally secures movable jaw 30 in a pivotal attachment to the interior of body 11 using conventional fabrication techniques. Movable jaw 30 is pivotable between the lowered position shown and the raised position shown in which movable jaw 30 is received within interior cavity 34 of body 11.

A lever 40 extends outwardly from interior cavity 34 of body 11 and is pivotally secured therein by pivot 41. A linkage 36 couples arm 35 to lever 40. Lever 40 terminates at the remaining end in a simulated toe chain 42 having a hook 43 disposed thereon.

In operation, with hook 43 and lever 40 pivoted upwardly to the raised position shown in solid line representation in FIG. 1, link 36 pivots arm 35 of movable jaw 30 in a counterclockwise direction about pivot 31 raising movable jaw 30 to its uppermost position within interior cavity 34. This position corresponds to the "normal" position and configuration of toy vehicle 10.

The configuration of toy vehicle 10 is altered by pivoting hook 43 and lever 40 downwardly in the direction indicated by arrow 44 to the dashed line position shown in FIG. 1. The pivotal motion of lever 40 about pivot 41 raises link 36 which in turn pivots arm 35 about pivot 31 and lowers movable jaw 30 to the position shown in FIG. 1 in a pivotal motion in the direction indicated by arrow 33.

Thus, the position of movable jaw 30 is moved between the closed appearance achieved when hook 43 is in the raised position giving toy vehicle 10 a normal appearance and the fanciful appearance produced by moving hook 43 downwardly to lower movable jaw 30 and provide a more fanciful appearance for toy vehicle 10.

Figure 2:
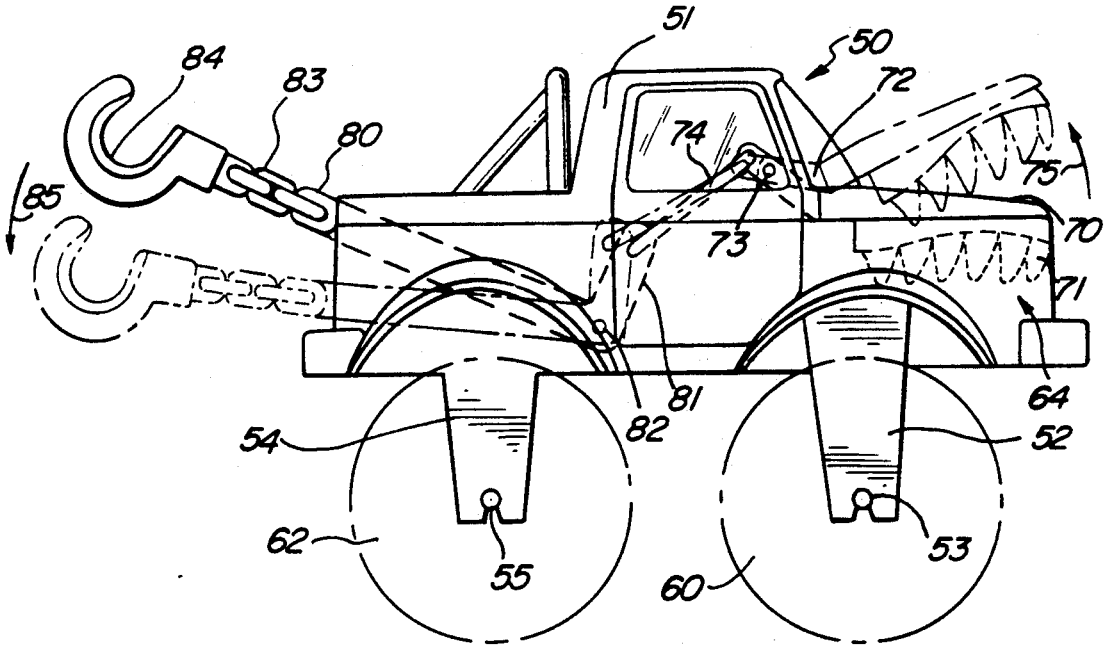
FIG. 2 sets forth a side view of an alternate embodiment of the present invention toy vehicle.

FIG. 2 sets forth a side view of an alternate embodiment of the present invention toy vehicle generally referenced by numeral 50. Toy vehicle 50 includes a simulated pickup truck body 51 having downwardly extending axle supports 52 and 54. Axle supports 52 and 54 receive and support a pair of axles 53 and 55 respectively. A plurality of rolling wheels 60 through 62 are received upon and supported by axles 53 and 55 in accordance with conventional fabrication techniques. Wheels 61 and 63 are supported on the opposite side of wheels 60 and 62 and thus are not seen in FIG. 2.

Toy vehicle 50 further includes a pivotally secured hood 70 having a plurality of downwardly extending simulated teeth 71 formed on the underside thereof. In the closed position shown in FIG. 2, simulated teeth 71 extend into interior cavity 64 formed within body 51 about toy vehicle 50. Hood 70 further includes an angularly extending pivot arm 72 which is pivotally secured to pivot 73 in accordance with conventional fabrication techniques. Hood 70 thus is pivotable about pivot 73 between the closed position shown in FIG. 2 in solid line representation and the dashed line configuration shown as hood 70 is pivoted upwardly in the direction indicated by arrow 75.

Toy vehicle 50 further includes an elongated lever 80 extending outwardly from body 51. Lever 80 is pivotally secured to body 51 by a pivot 82 in accordance with conventional fabrication techniques. Lever 80 also defines an angularly disposed arm 81 and an outwardly extending simulated chain 83 and hook 84. A link 74 is coupled between arm 81 of lever 80 and arm 72 of hood 70.

In operation, with lever 80 in the raised position shown in solid line representation in FIG. 2, arm 81 is pivoted in the clockwise direction about pivot 82 which in turn pivots arm 72 and hood 70 in the clockwise direction about pivot 73 causing hood 70 to assume the closed position shown in solid line representation. This corresponds to the "normal" appearance configuration of toy vehicle 50. As hook 84 and lever 80 are pivoted downwardly in the direction indicated by arrow 85, however, a counterclockwise pivotal motion is produced in arm 81. This counterclockwise pivotal motion is coupled by link 74 to arm 72 causing hood 70 to be pivoted about pivot 73 and raised in the direction indicated by arrow 75. With lever 80 fully pivoted, hood 70 assumes the open configuration shown in dashed line representation in FIG. 2 exposing simulated teeth 71 and producing a fanciful appearance for toy vehicle 50. Conversely, pivoting lever 80 upwardly returns lever 80 to the raised position shown and pivots hood 70 downwardly to return to the closed position shown in solid line representation in FIG. 2.

Figure 3:
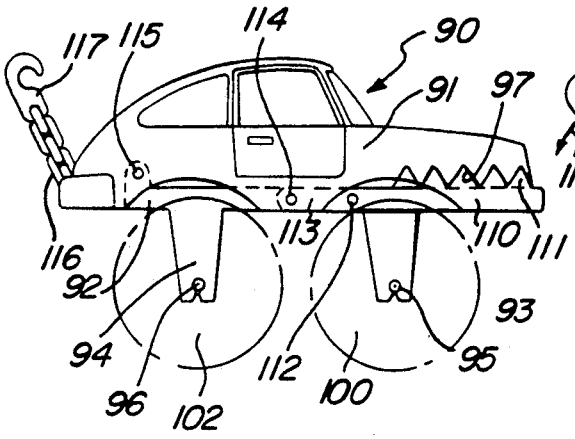
FIGS. 3 and 4 set forth sequential side views of the operation of a still further alternate embodiment of the present invention.
Figure 4:
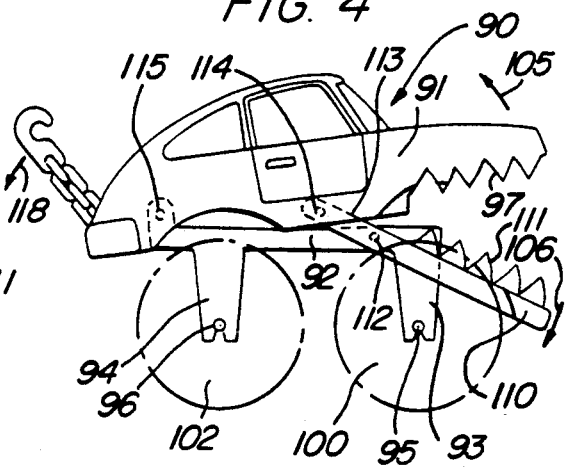

FIGS. 3 and 4 set forth the open and closed positions of a still further alternate embodiment of the present invention toy vehicle generally referenced by numeral 90. Toy vehicle 90 is shown in FIG. 3 in its closed or normal appearance configuration and is shown in FIG. 4 in its open or fanciful configuration.

With specific reference to FIG. 4, toy vehicle 90 includes a vehicle body 91 having an angularly disposed lever 116 extending from the rear portion of body 91 and terminating in a hook 117. Lever 116 is fixedly secured to body 91. Toy vehicle 90 further includes a supporting chassis 92 having downwardly extending axle supports 93 and 94. Axle supports 93 and 94 in turn support a pair of axles 95 and 96. A plurality of rolling wheels 100 through 103 are secured to and supported by axles 95 and 96 in accordance with conventional fabrication techniques. Wheels 101 and 103 are secured oppositely from wheels 100 and 102 respectively and thus are not visible in FIGS. 3 and 4. Chassis 92 further includes a pivot 115 providing a pivotal attachment between body 91 and chassis 92.

Body 91 further defines a jaw 110 pivotally secured to chassis 92 by a pivot 112. Jaw 110 further includes a plurality of upwardly extending teeth 111 and a rearwardly extending arm 113. Arm 113 is pivotally secured to the interior of body 91 by a pivotal attachment 114. Body 91 also defines a plurality of teeth which are configured to be received in an interlocking relationship with teeth 111 of jaw 110.

In operation and in the absence of a downward force upon hook 117 and lever 116, toy vehicle 90 assumes the "normal" or closed position shown in FIG. 3. When so positioned, body 90 remains pivoted downwardly with respect to pivot 115 while jaw 110 assumes a generally horizontal alignment with chassis 92. As a result, teeth 97 of body 91 and teeth 111 of jaw 110 are combined or nested which minimizes the appearance factor of jaw 110 and teeth 97 and 111.

FIG. 4 sets forth the configuration of toy vehicle 90 in response to a downward force upon hook 117 and lever 116. Thus, as hook 117 and lever 116 are forced downwardly, a pivotal motion in the direction of arrow 118 results which in turn pivots body 91 about pivot 115 upwardly in the direction indicated by arrow 105. As body 91 pivots upwardly, it separates from chassis 92 and raises pivot 114. The upward motion of pivot 114 causes a corresponding pivotal motion of jaw 110 with respect to pivot 112. Thus, jaw 110 pivots downwardly about pivot 112 in the direction indicated by arrow 106. It should be noted that the pivotal motion of jaw 110 must be accommodated by either the pivotal attachment at pivot 112 or the pivotal attachment at pivot 114 due to the changing linear distance between pivots 112 and 114 as jaw 110 pivots. For example, it has been found preferable to provide an enlarged aperture at the pivotal coupling at pivot 114 which allows this displacement. With hook 117 and lever 116 fully depressed, body 91 is raised to its full upward position while jaw 110 is lowered to its full downward position. As a result, a maximal separation occurs between teeth 111 and teeth 97 providing a fanciful open mouth appearance for toy vehicle 90. Once the downward force upon hook 117 and lever 116 is removed, the gravitational force upon body 91 pivots body 91 downwardly about pivot 115 causing jaw 110 to be pivoted upwardly and providing a return of toy vehicle 90 to the closed position of FIG. 3.

Figure 5:
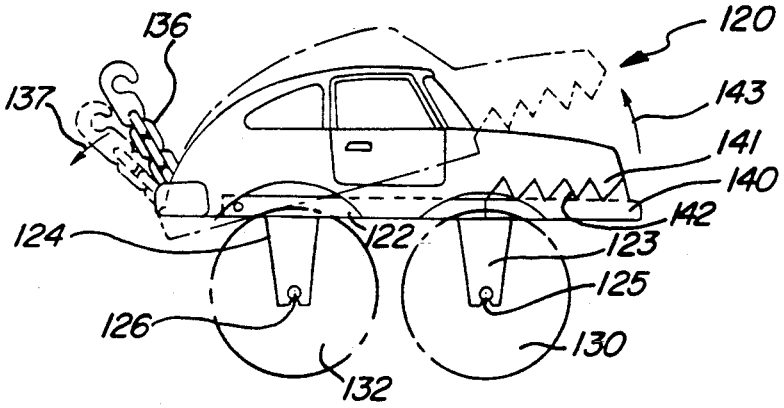
FIG. 5 sets forth a side view of a still further alternate embodiment of the present invention toy vehicle.

FIG. 5 sets forth a side view of a still further alternate embodiment of the present invention generally referenced by numeral 120. Toy vehicle 120 includes a body 121 having an angularly disposed upwardly extending lever 136 fixedly secured thereto. Toy vehicle 120 further includes a supporting chassis 122 having downwardly extending axle supports 123 and 124. Axle supports 123 and 124 receive and support a pair of transverse axles 125 and 126. A plurality of rolling wheels 130 through 133 are received upon and secured to axles 125 and 126 in accordance with conventional fabrication techniques. Wheels 131 and 133 are oppositely positioned and aligned with wheels 130 and 132 and thus are not seen in FIG. 5. Chassis 122 further defines a fixed jaw 140 having a plurality of upwardly extending teeth 142 formed therein. Vehicle body 121 defines a cooperating set of teeth 142 which nests with and are received by teeth 141 in the closed position shown in solid line representation in FIG. 5. Body 121 is pivotally secured to chassis 122 by a pivotal attachment 134.

In operation, in the absence of a downward force upon lever 136, vehicle body 121 pivots downwardly about pivot 134 causing teeth 141 to be received by teeth 142 of fixed jaw 140. Thus, vehicle 120 assumes the closed position shown in solid line representation.

With the application of a downward force upon lever 136, however, lever 136 is pivoted downwardly in the direction indicated by arrow 137 causing vehicle body 121 to pivot upwardly about pivot 134 in the direction indicated by arrow 143. At the completion of such pivotal motion, body 121 has been raised to the dashed line position shown in FIG. 5 in which teeth 142 of body 121 are raised above and separated from teeth 141 of fixed jaw 140. Thus, toy vehicle 120 assumes the fanciful configuration depicting an open mouth configuration. Once the downward force upon lever 136 is released, the effect of gravity upon body 121 pivots body 121 downwardly about pivot 134 returning teeth 142 to the interlocking position with teeth 141 and returning toy vehicle 120 to the closed mouth or "normal" appearance configuration.

Figure 6:
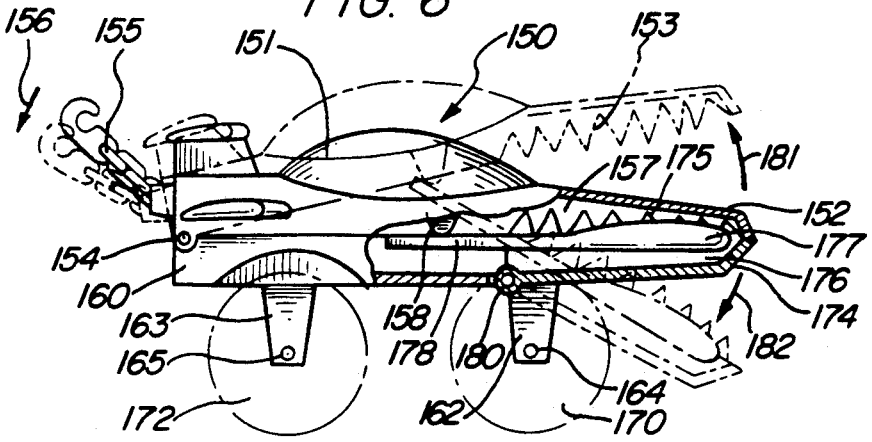
FIG. 6 sets forth a side view of a still further alternate embodiment of the present invention toy vehicle.

FIG. 6 sets forth a side view of still further alternate embodiment of the present invention toy vehicle generally referenced by numeral 150. Toy vehicle 150 includes a body 151 defining an interior cavity 157. Vehicle body 151 further defines an upper jaw 152 having a plurality of downwardly extending teeth 153. Toy vehicle 150 further includes a chassis 160 having downwardly extending axle supports 162 and 163. Axle supports 162 and 163 receive and support a pair of axles 164 and 165 in accordance with conventional fabrication techniques. A plurality of rolling wheels 170 through 173 are received upon and secured to axles 164 and 165 in accordance with conventional fabrication techniques. Because wheels 171 and 173 are oppositely positioned with respect to wheels 170 and 172, they are not visible in FIG. 6. Vehicle body 151 further includes an angularly disposed fixedly secured lever 155. A pivotal attachment 154 pivotally secures body 151 to chassis 160. A downwardly extending tab 158 is supported within interior cavity 157 of vehicle body 151.

Toy vehicle 150 further includes a lower jaw 174 having a plurality of upwardly extending teeth 175. Lower jaw 174 further defines an upwardly extending support web 176 which supports a simulated tongue 177. Tongue 177 further includes a rearwardly extending arm 178. A pivotal attachment 180 secures lower jaw 174 to chassis 160.

In operation, in the absence of a downward force upon lever 155, the gravitational force upon body 151 pivots body 151 about pivot 154 downwardly to the closed position shown in solid line representation in FIG. 6. Correspondingly, the downward movement of body 151 forces tab 158 downwardly upon arm 178. The downward force upon arm 178 pivots lower jaw 174 about pivot 180 to the raised position shown in solid line representation in FIG. 6. Thus, in the absence of a downward force upon lever 155, toy vehicle 150 assumes the closed mouth configuration shown in solid line representation.

Upon the application of a downward force upon lever 155, lever 155 is pivoted downwardly about pivot 154 causing a corresponding upwardly directed pivotal motion of body 151 in the direction indicated by arrow 181. The raising of body 151 also raises tab 158 which allows lower jaw 174 to pivot downwardly about 180 in the direction indicated by arrow 182. Thus, as lever 155 is pivoted to the fully downward position shown in dashed line representation, body 151 pivots upwardly to the dashed line position shown allowing lower jaw 174 to pivot downwardly to the dashed line position shown. As a result, toy vehicle 150 assumes the open mouth appearance shown in dashed line representation.

Once the downward force upon lever 155 is released, the gravitational force upon body 151 pivots it downwardly forcing tab 158 against arm 178 of lower jaw 174 pivoting jaw 174 upwardly where upon toy vehicle 150 returns to the closed mouth position.

Figure 7:
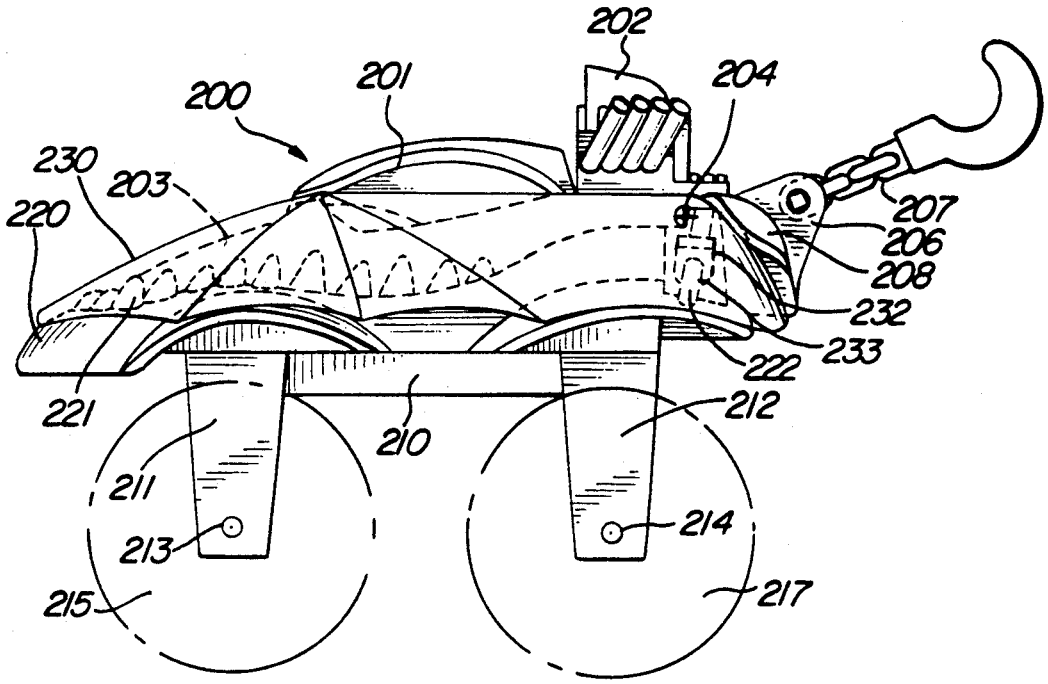
FIGS. 7 and 8 set forth sequential side views of a still further alternate embodiment of the present invention toy vehicle.
Figure 8:
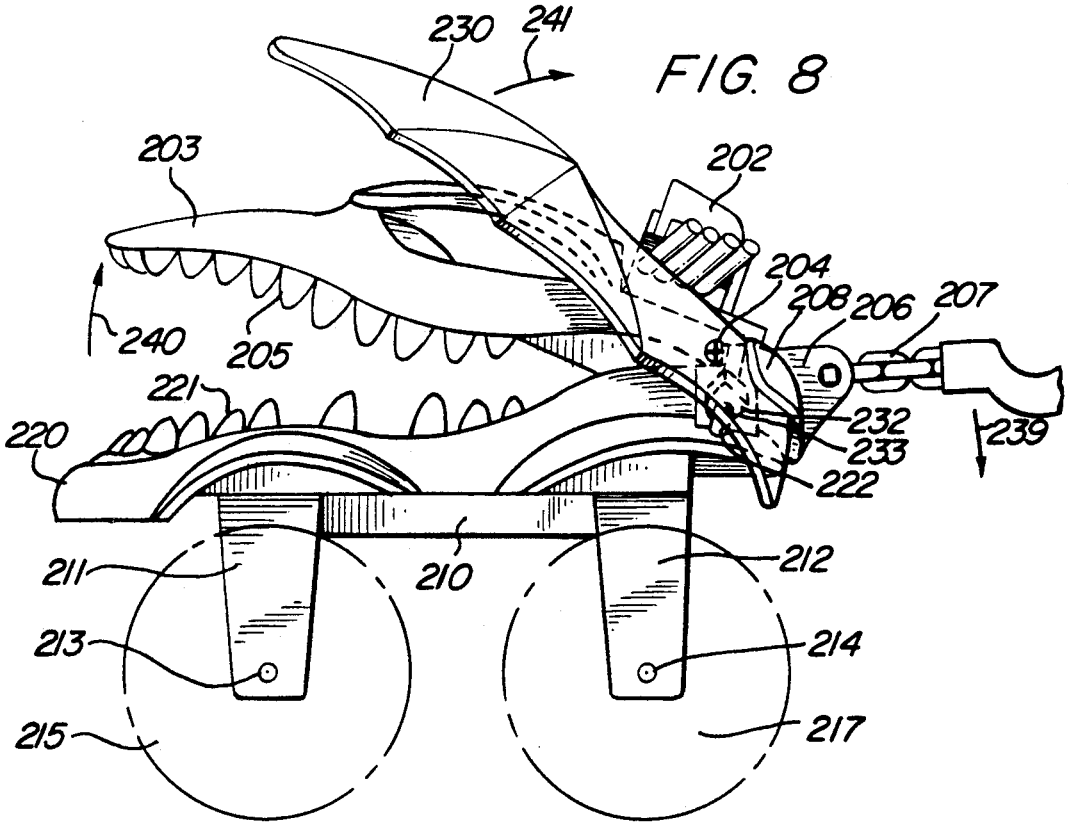

FIGS. 7 and 8 set forth side views of a still further alternate embodiment of the present invention toy vehicle generally referenced by numeral 200. Toy vehicle 200 is shown in the closed position in FIG. 7 and in the open position in FIG. 8. With specific reference to FIG. 7, toy vehicle 200 includes a body 201 defining an upper jaw 203 having a plurality of downwardly extending teeth 205 (better seen in FIG. 8). Body 201 further defines a simulated engine 202 and a rearwardly extending lever support 206. An angularly disposed lever 207 is coupled to lever support 206 in a secure attachment. Body 201 further includes a pair of outwardly extending tabs 208 and 209 (the latter better seen in FIG. 9).

Toy vehicle 200 further includes a support chassis 210 having downwardly extending axle supports 211 and 212. A pair of axles 213 and 214 are received and supported by axle supports 211 and 212 in accordance with conventional fabrication techniques. A plurality of rolling wheels 215 through 218 are secured to axles 213 and 214. Wheels 216 and 218 are better seen in FIG. 9.

Toy vehicle 200 further includes a lower jaw 220 secured to and supported by chassis 210. Lower jaw 220 defines a plurality of upwardly extending teeth 221 and a pair of angularly disposed axles 222 and 223 (the latter seen in FIG. 9). Body 201 is pivotally secured to lower jaw 220 by a pivotal attachment 204. A pair of wings 230 and 231 (the latter seen in FIG. 9) define a pair of downwardly extending tabs 232 and 234 which in turn define apertures 233 and 235 respectively. Tab 234 and aperture 235 are better seen in FIG. 9. Apertures 233 and 235 receive angularly disposed axles 222 and 223 respectively to provide a pivotal attachment between wings 230 and 231 and lower jaw 220. Because of the angular disposition of axles 222 and 223, the rotational motion of wings 230 and 231 includes both an opening and rising direction motion which is better seen in FIG. 9 below. Suffice it to note here, however, that in the closed position shown, wings 230 and 231 are brought together in a closed position generally overlying body 201.

In the absence of a downward force upon lever 207, toy vehicle 200 assumes the closed position shown in FIG. 7. Thus, the gravitational force upon body 200 causes body 200 to rest upon lower jaw 220. Correspondingly, the gravitational force upon wings 230 and 231 causes them to pivot downwardly about angled axles 222 and 223 and rest upon body 201 and lower jaw 220.

When a downward force is applied to lever 207, however, lever support 206 is pivoted downwardly about pivot 204 causing body 201 to pivot upwardly in the direction indicated by arrow 240 in FIG. 8. Thus, with reference to FIGS. 7 and 8 taken together, the continued downward force upon lever 207 pivots lever 207 and lever support 206 about pivot 204 in the direction indicated by arrow 239. As body 201 pivots in the direction indicated by arrow 240, tabs 208 and 209 (the latter seen in FIG. 9) are forced against the rear portions of wings 230 and 231 respectively. Because the force applied by tabs 208 and 209 is to the rear of angled axles 222 and 223, wings 230 and 231 are pivoted about axles 222 and 223 in the direction indicated by arrow 241. As mentioned above, the angular disposition of axles 222 and 223 causes the pivotal motion of wings 230 and 231 to rise upwardly as the wings pivot outwardly from body 201. As a result, as lever 207 continues to pivot downwardly in the direction indicated by arrow 239, body 201 continues to pivot upwardly about pivot 204 raising body 201 in the direction indicated by arrow 240 while tabs 208 and 209 continue to pivot wings 230 and 231 upwardly and outwardly in the direction indicated by arrow 241 until toy vehicle 200 assumes the fully open position shown in FIG. 8.

Once the downward force upon lever 207 is released, the gravitational force upon body 201 pivots upper jaw 203 downwardly to the closed position shown in FIG. 7. This downward motion of body 201 also raises tabs 208 and 209 releasing wings 230 and 231 whereupon the gravitational force upon the wings returns them to the closed position shown in FIG. 7.

Figure 9:
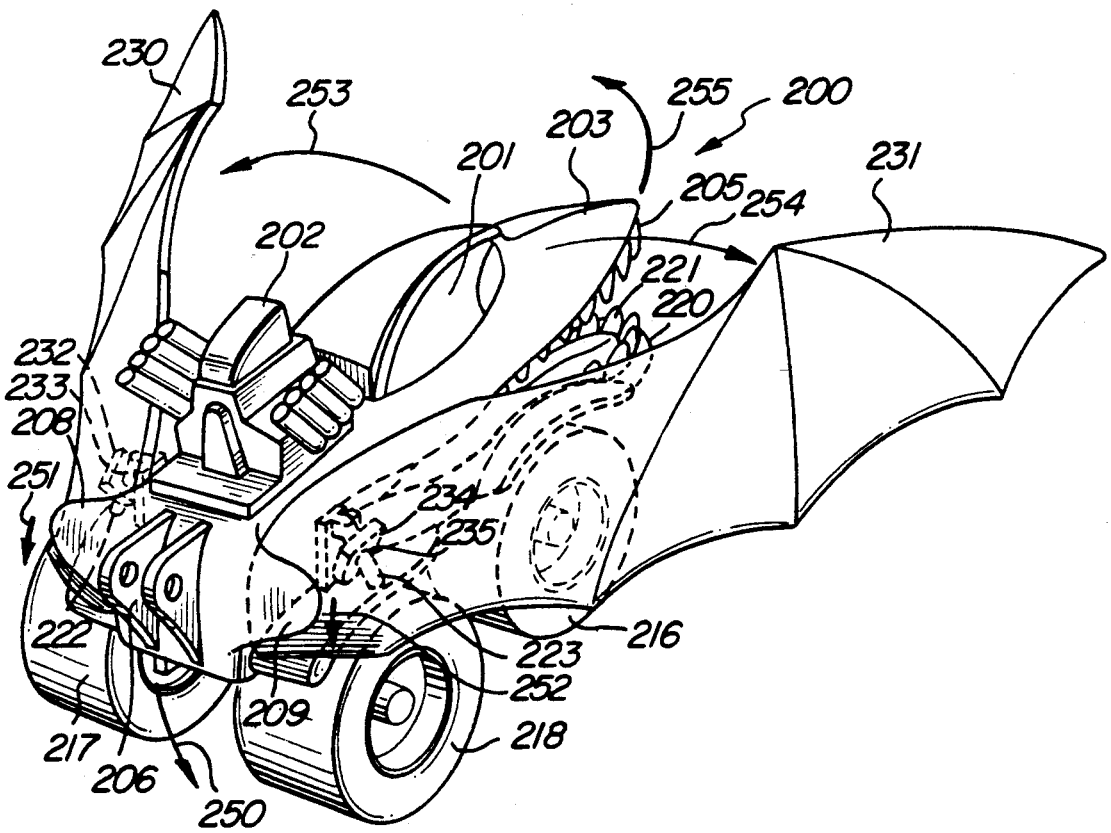
FIG. 9 sets forth a rear perspective view of the alternate embodiment of the present invention set forth in FIGS. 7 and 8.

FIG. 9 sets forth a rear perspective view of toy vehicle 200 in the open position corresponding to that shown in FIG. 8. As described above, vehicle 200 includes a body 201 having an upper jaw 203 pivotally secured to a lower jaw 220. Body 201 further includes a lever support 206 and a pair of outwardly extending tabs 208 and 209. A plurality of teeth 205 extend downwardly from upper jaw 203. Lower jaw 220 is supported by chassis 210 (better seen in FIG. 7) and includes a pair of angularly disposed axles 222 and 223. Lower jaw 220 further defines a plurality of upwardly extending teeth 221. A pair of wings 230 and 231 define a corresponding pair of downwardly extending tabs 232 and 234 respectively. Tabs 232 and 234 define apertures 233 and 235 which receive angularly disposed axles 222 and 223 respectively.

In operation, a downward force in the direction indicated by arrow 250 applied to lever support 206 by lever 207 (seen in FIG. 7) produces a pivotal motion of body 201 raising upper jaw 203 in the direction indicated by arrow 255 and lowering tabs 208 and 209 in the direction indicated by arrows 251 and 252. The downward force upon wings 230 and 231 provided by tabs 208 and 209 respectively pivots wings 230 and 231 upwardly and outwardly in the directions indicated by arrows 253 and 254. Thus, the angular disposition of axles 222 and 223 provides an opening and upward extension of wings 230 and 231 as they pivot. As a result, toy vehicle 200 responds to the downward force upon lever support 206 to open wings 230 and 231 in an upwardly and outwardly fanning motion while raising upper jaw 203 to provide a menacing open mouth appearance. Upon release of the downward force upon lever support 206, the gravitational force upon body 201 pivots it downwardly returning it to the closed mouth position of FIG. 7. Correspondingly, the downward motion of body 201 produces an upward motion of tabs 208 and 209 releasing wings 230 and 231 and permitting the wings to pivot downwardly and inwardly to close upon body 201 and restore the closed position shown in FIG. 7.

What has been shown is a plurality of toy vehicles having articulated jaw mechanisms which are operated in response to a rearwardly extending lever to provide configuration of the toy vehicle in a closed or normal position and an open mouth menacing position. The structure shown requires a minimum of mechanical complexity and increased cost while providing a maximum of amusement value.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a support chassis having a plurality of supporting wheels;

a lower jaw portion coupled to said support means defining a plurality of upwardly extending teeth and a pivotal attachment;

a body defining an upper jaw portion pivotally secured to said lower jaw portion at said pivotal attachment;

a pair of wings pivotally secured to said lower jaw portion;

operative means coupled to said body and said wings for separating said wings as said body pivots upwardly and for closing said wings as said body pivots downwardly; and lever means coupled to said body for pivoting said body between a lowered closed position and a raised open position.

2. A toy vehicle as set forth in claim 1 wherein said lower jaw portion includes a pair of axles angled outwardly and downwardly from said lower jaw portion and wherein said wings pivot about said axles.

3. A toy vehicle as set forth in claim 2 wherein said wings each define an axle tab pivotally coupled to said axles.

4. A toy vehicle as set forth in claim 3 wherein said operating means include a pair of push tabs extending outwardly from said body at points rearward of said pair of axles, said push tabs pushing against said wings at points rearward of said axle tabs.

5. A toy vehicle as set forth in claim 4 wherein said lever means includes a lever extending upwardly and rearwardly from said body from a point rearward of said pivotal attachment between said body and said lower jaw portion.

* * * * *